US009774157B2

(12) United States Patent
Patel et al.

(10) Patent No.: US 9,774,157 B2
(45) Date of Patent: Sep. 26, 2017

(54) POWER CONNECTOR

(71) Applicant: Molex, LLC, Lisle, IL (US)

(72) Inventors: Arvind Patel, Naperville, IL (US); Jeng-De Lin, Yorkville, IL (US); Kenneth Stead, Aurora, IL (US); David L. Brunker, Naperville, IL (US); David E. Dunham, Metamora, MI (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/898,397

(22) PCT Filed: Jul. 11, 2014

(86) PCT No.: PCT/US2014/046279
§ 371 (c)(1),
(2) Date: Dec. 14, 2015

(87) PCT Pub. No.: WO2015/006644
PCT Pub. Date: Jan. 15, 2015

(65) Prior Publication Data

US 2016/0149363 A1 May 26, 2016

Related U.S. Application Data

(60) Provisional application No. 61/845,419, filed on Jul. 12, 2013.

(51) Int. Cl.
*H01R 12/00* (2006.01)
*H01R 27/02* (2006.01)
(Continued)

(52) U.S. Cl.
CPC ..... *H01R 27/02* (2013.01); *H01R 13/04* (2013.01); *H01R 12/7088* (2013.01);
(Continued)

(58) Field of Classification Search
CPC ..... H01R 27/00; H01R 27/02; H01R 13/02; H01R 13/04; H01R 12/7088; H01R 12/724; H01R 12/732; H01R 13/113
(Continued)

(56) References Cited

U.S. PATENT DOCUMENTS 5,147,228 A 9/1992 Miller et al.
5,785,557 A 7/1998 Davis
(Continued)

FOREIGN PATENT DOCUMENTS

CN 2491977 Y 5/2002

*Primary Examiner* — Khiem Nguyen
(74) *Attorney, Agent, or Firm* — James A. O'Malley

(57) ABSTRACT

A power module of an electrical connector is provided which has a dielectric housing and a pair of blade terminals. The housing has a forward face and a support arm projecting forwardly from the face. The support arm has opposing first and second sides. The housing has a cavity. The face has a pair of slots extending therethrough which are in communication with the cavity and which are provided adjacent the sides of the support arm. Each of the blade terminals has a body portion and a blade portion. The body portions are housed in the cavity and the blade portions extend through the slots and are positioned alongside the sides of the support arm. The electrical connector may also have a signal module interconnected to the power module. The electrical connector may also be configured to mate with another electrical connector as part of a connector assembly.

35 Claims, 10 Drawing Sheets

(51) Int. Cl.

| | |
|---|---|
| ***H01R 13/04*** | (2006.01) |
| *H01R 12/70* | (2011.01) |
| *H01R 12/72* | (2011.01) |
| *H01R 12/73* | (2011.01) |
| *H01R 13/11* | (2006.01) |

(52) U.S. Cl.
CPC ..... *H01R 12/724* (2013.01); *H01R 12/732* (2013.01); *H01R 13/113* (2013.01)

(58) Field of Classification Search
USPC ..... 439/79, 625, 626, 638, 639
See application file for complete search history.

(56) References Cited

U.S. PATENT DOCUMENTS

| | | | | |
|---|---|---|---|---|
| 5,833,497 | A | 11/1998 | Byfield, Jr. | |
| 6,319,075 | B1 | 11/2001 | Clark et al. | |
| 6,471,523 | B1 | 10/2002 | Shuey | |
| 7,909,668 | B2 | 3/2011 | McAlonis et al. | |
| 7,976,317 | B2 | 7/2011 | Patel et al. | |
| 8,657,616 | B2 | 2/2014 | Raistrick et al. | |
| 8,814,595 | B2 | 8/2014 | Cohen et al. | |
| 2003/0219999 | A1* | 11/2003 | Minich et al. ..... | H01R 12/00 439/79 |
| 2008/0139041 | A1 | 6/2008 | Margulis et al. | |
| 2009/0142953 | A1* | 6/2009 | Patel et al. ..... | H01R 13/631 439/345 |
| 2009/0291579 | A1 | 11/2009 | Farole et al. | |

* cited by examiner

POWER CONNECTOR

RELATED APPLICATIONS

This application claims priority to U.S. Provisional Application No. 61/845,419, filed Jul. 12, 2013 which is incorporated herein by reference in its entirety.

FIELD OF THE INVENTION

The present invention relates to field of connectors, more specifically the field of connectors suitable for providing power.

DESCRIPTION OF RELATED ART

Generally, an electrical connector includes some form of insulative or dielectric housing which mounts one or more conductive terminals. The housing is configured for mating with a complementary mating connector or other connecting device which, itself, has one or more conductive terminals. A connector assembly typically includes a pair of mating connectors, such as plug and receptacle connectors sometimes called male and female connectors of which, corresponding terminals of the connectors, themselves, may be male and female terminals.

Existing computer systems tend to have a power supply positioned in one location and various components that use the provided power in other locations. This allows for desirable thermal management and further allows for the positioning of processors in the preferred location. One issue that results from such a configuration, however, is that the supplied power must be delivered to the various consumption devices. For certain devices this is not an issue. However, for other power consumption devices (such as CPU or other devices that change power states rapidly) the distance creates certain issues.

One issue that is commonly present is the issue of inductance between the power supply and the power consumption device. As is known, current flowing along a path will generate a magnetic field that will act to resist the flow of current. Many modern power consumption devices switch power usage at relatively high frequencies (e.g., up to and beyond 1 MHz). The rapid switching of power causes the voltage being delivered to sag, which can be problematic to the consumption device, depending on the sensitivity of such a device to variations in the provided power. Thus, for certain applications it has been determined that such voltage sag is unacceptable and therefore capacitors are provided adjacent the power consumption device so as to ensure a constant voltage is supplied. Certain individuals would appreciate being able to reduce or eliminate the use of capacitors

BRIEF SUMMARY

The present disclosure generally relates to combined electrical power and signal connectors that can be integrated into a connector system and that can provide desirable operation under high current density conditions. In general, connectors are suitable for use as modular components within modular assemblies. For example, modular assemblies can take, for example, the form of wire-to-board or wire-to-wire connectors and can, when desired, provide a low-profile connector system.

A connector assembly may be provided that includes a plug connector and a receptacle connector. The connector assembly includes one or more blade-type power contacts on the plug connector and multiple-pronged power contacts on the receptacle connector. The plug connector includes signal pin contacts mounted within a shrouded area of the connector. The receptacle connector may include a signal module that is slidably mateable with the receptacle connector. A power contact includes a pair of blade portions forming the mating portion of the power contact with an intermediate insulator spaced between each conductive blade portions. Thus, the connector allows power and signals to be coupled together with a single connector assembly.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Figure 1:
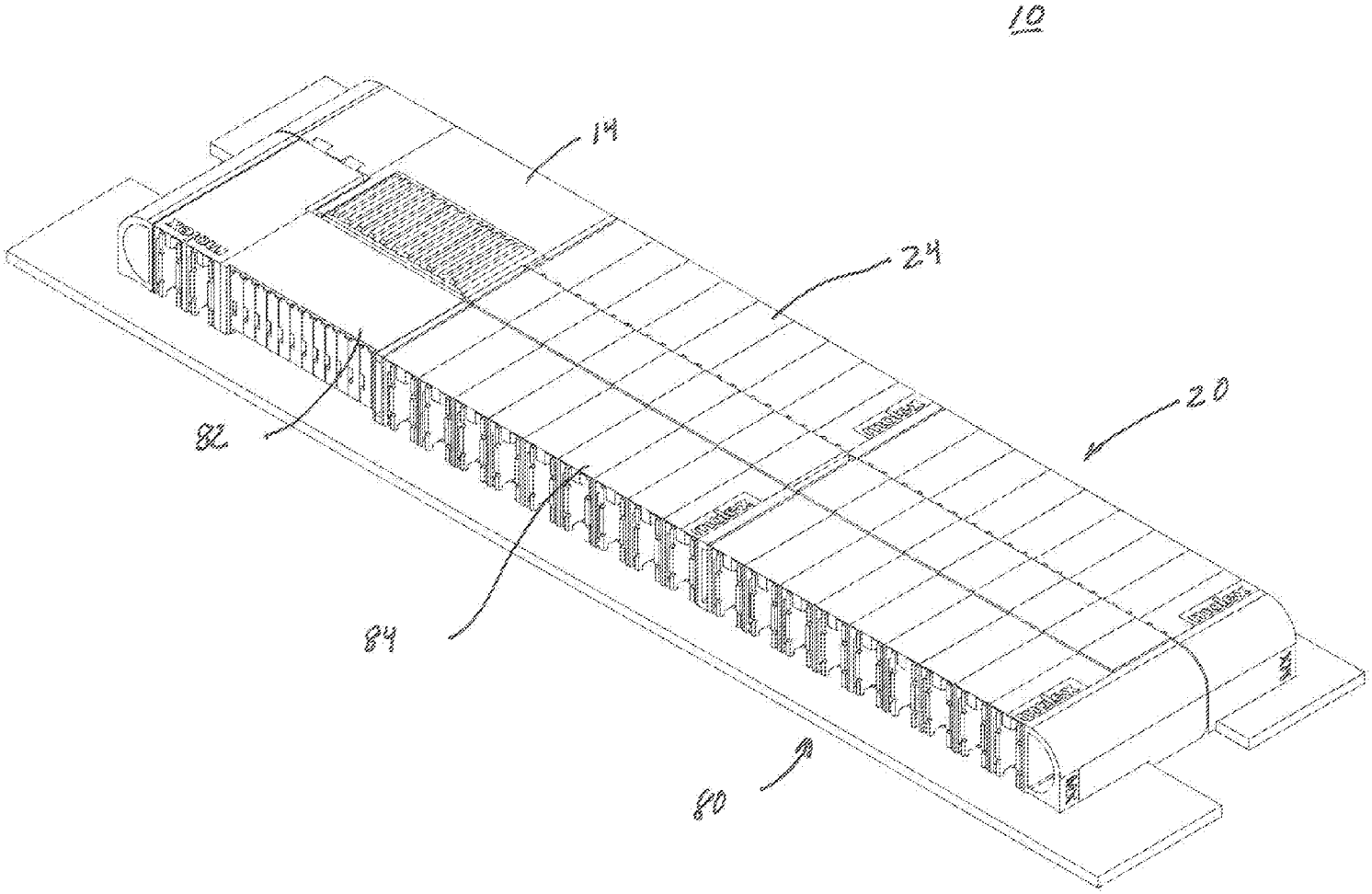
FIG. 1 is a perspective view of an electrical blade connector.
Figure 2:
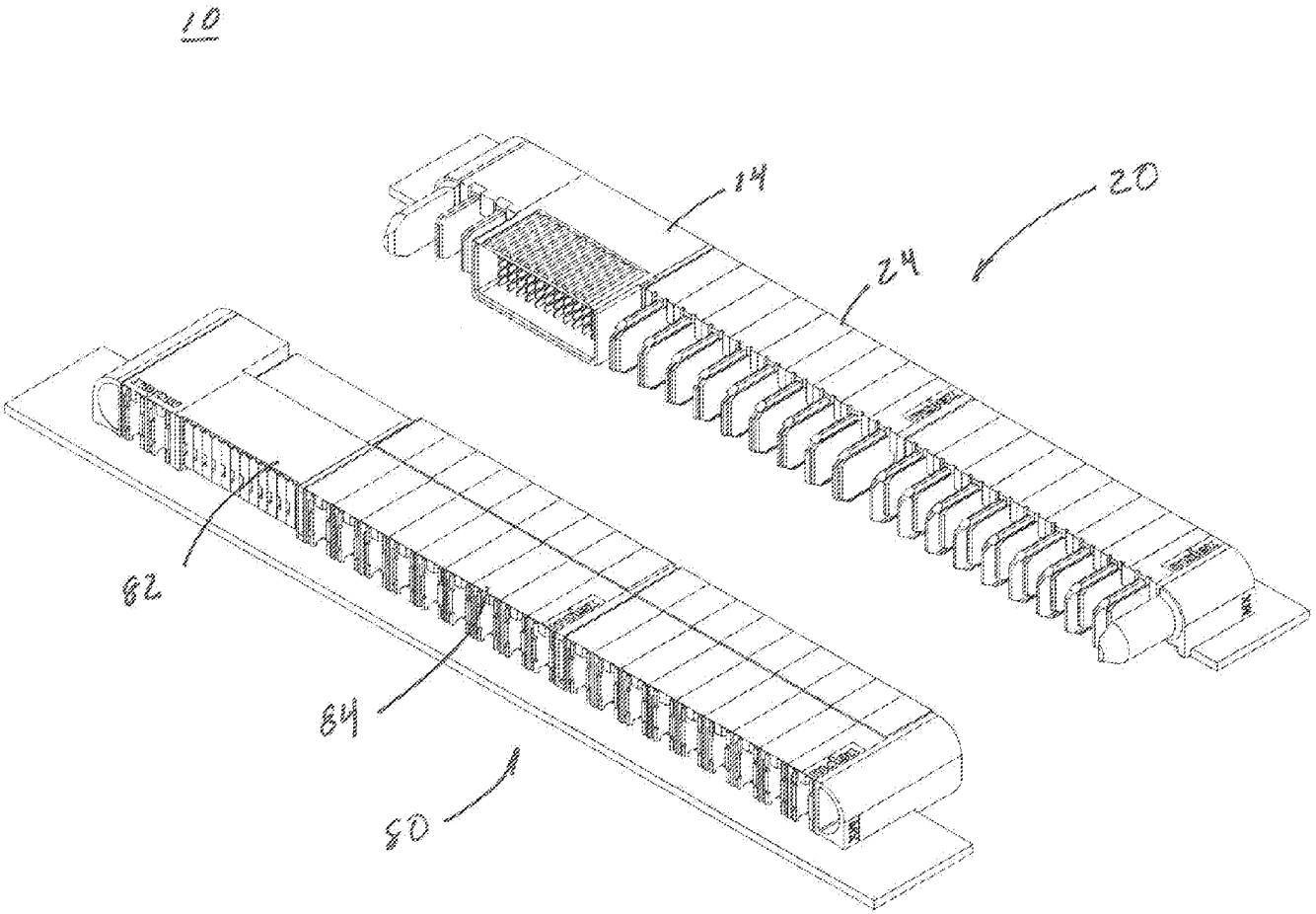
FIG. 2 is an unmated perspective view of the blade connector of FIG. 1.

FIGS. 1 and 2 illustrate an embodiment of the present invention and it is to be understood that the disclosed embodiment is merely exemplary, which may be embodied in various forms. Therefore, specific details disclosed herein are not to be interpreted as limiting, but merely as a basis for the claims and as a representative basis for teaching one skilled in the art.

One or more embodiments of the present disclosure utilizes multiple both signal and power circuits in a connector system that provide proper alignment, mechanical connection and electrical connection, while providing a low profile connection. If desired the configuration can be modified to provide board-to-board, wire-to-board and wire-to-wire connection.

Figure 3:
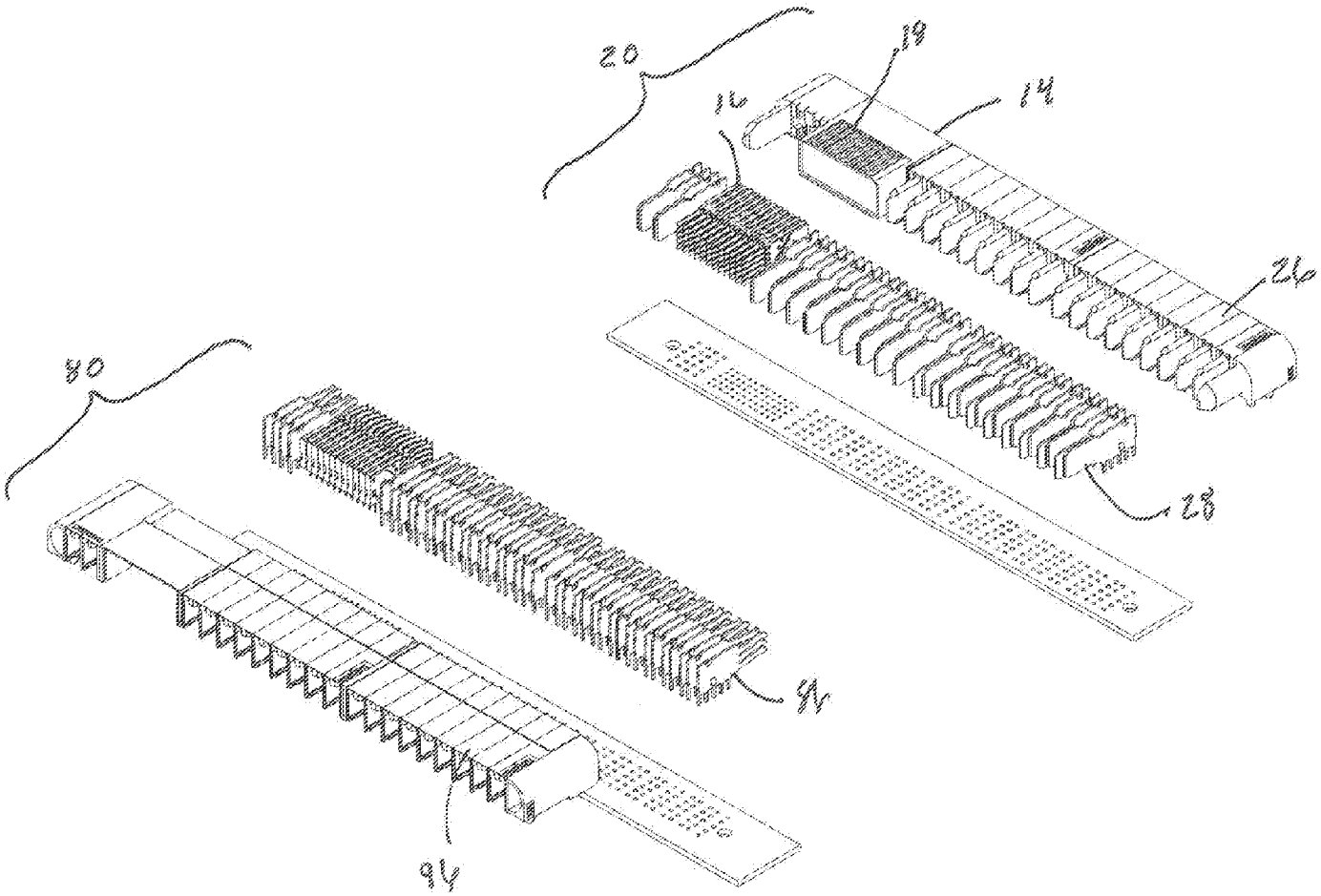
FIG. 3 is an exploded view of the blade connector of FIGS. 1 and 2.

FIGS. 1-3 illustrate an embodiment of a board-to-board connector assembly 10 including a first connector 20 and a second mating connector 80 with each connector 20, 80 including a plurality of modules. The connector system 10 is configured to include a first connector 20 having a plurality of individual modules including both signal 14 and power types 24 and a second connector 80 having a plurality of cooperating mating modules including signal 82 and power types 84. Typically, individual modules 14, 24 are aligned in a linear array with an interlocking structure to secure the modules 14, 24 together in a side by side arrangement. This interlocking arrangement can include and is not limited to a dovetail type interlock (not shown).

A typical signal module 14 generally is comprised of a series of over-molded wafers 16 having a number of signal circuits held within a shroud or holding assembly 18. The wafers 16 are retained in the holding assembly 18 generally by a snap fit and an optional stiffener, which in turn is secured to an adjacent module of either signal 14 or power type 24.

Figure 4:
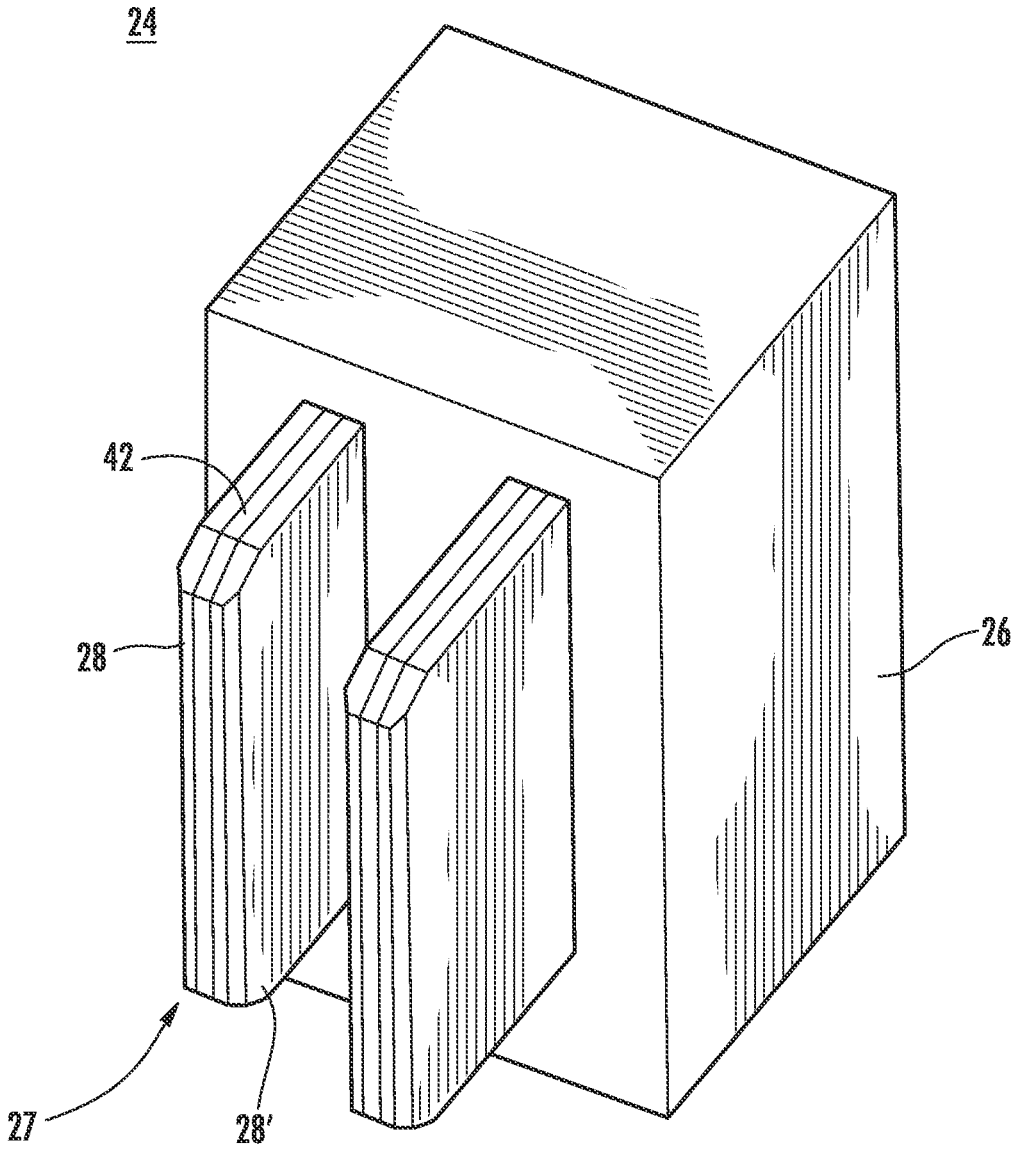
FIG. 4 is a perspective view of a power module of the electrical blade connector.
Figure 5:
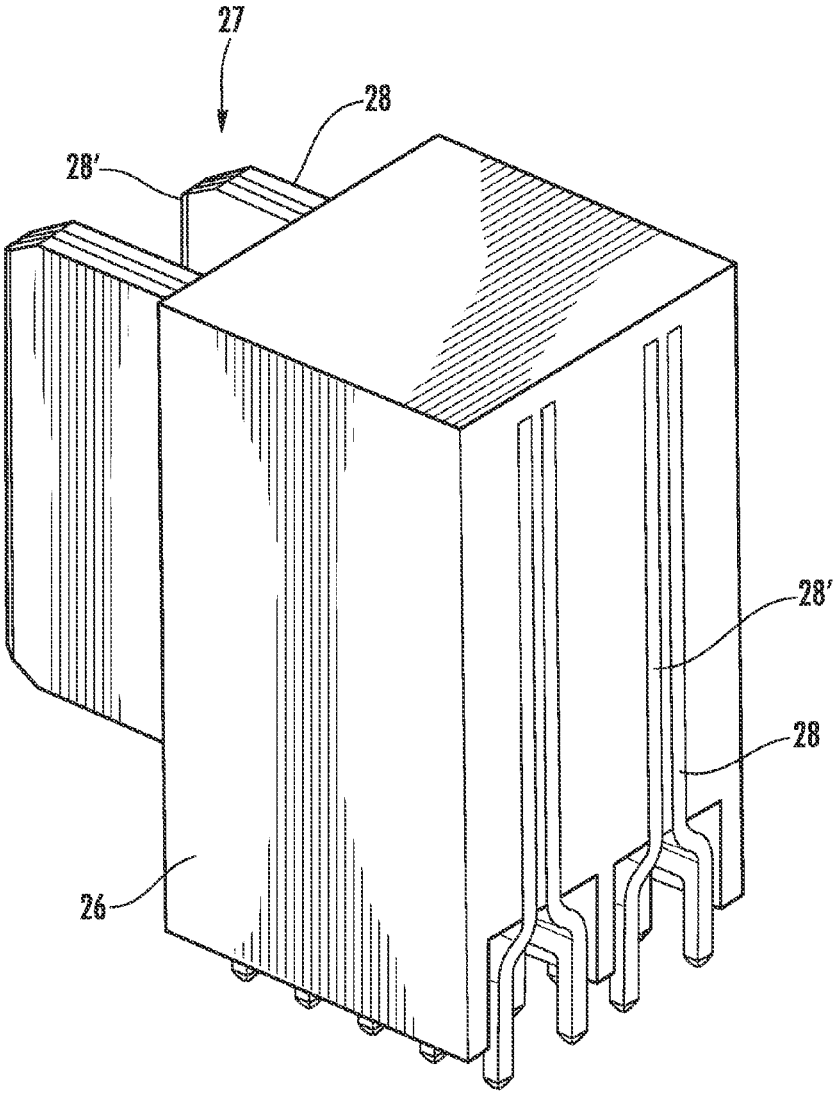
FIG. 5 is a perspective view of a power module of the electrical blade connector FIG. 5 looking from the rear of the module.
Figure 6:
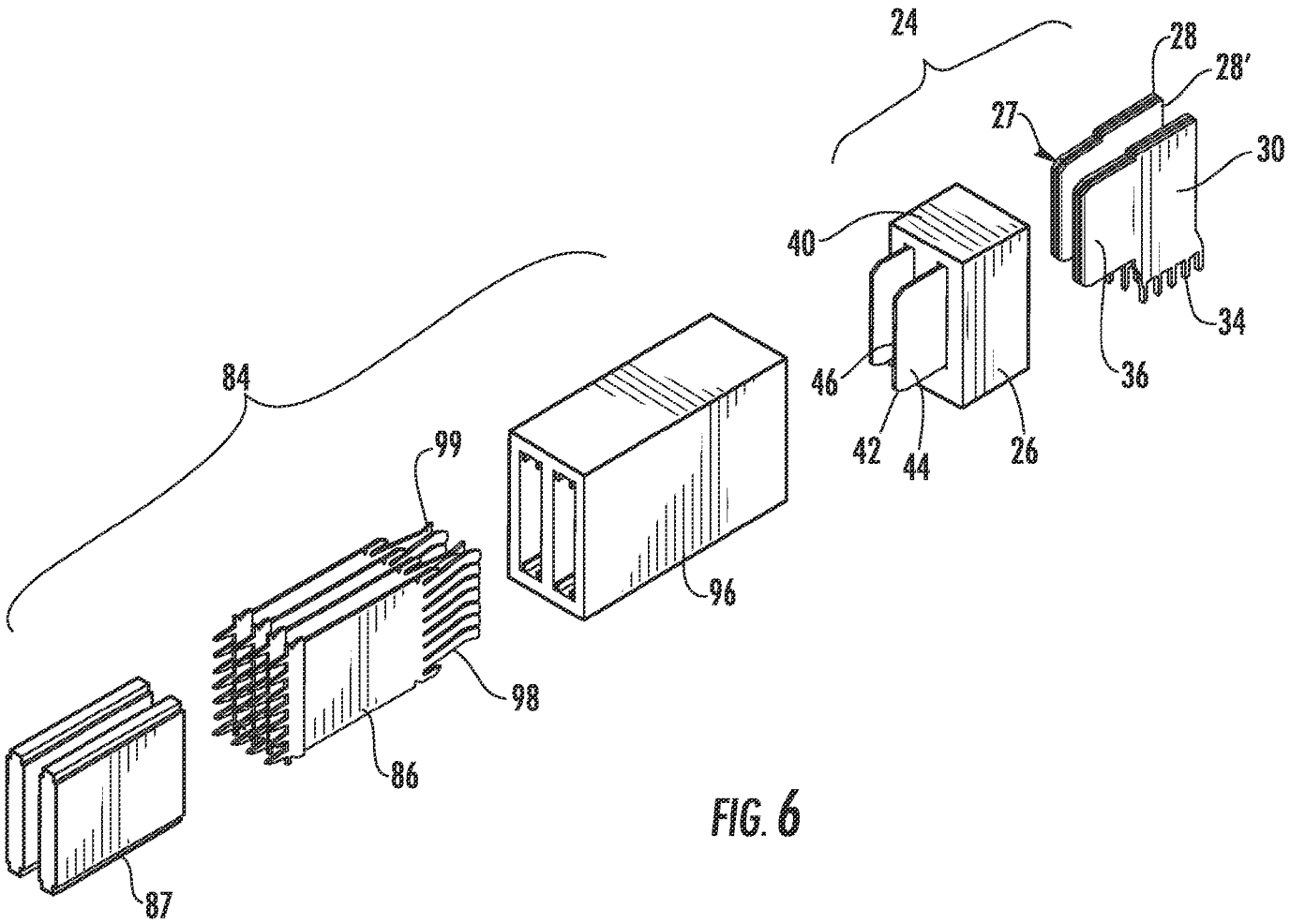
FIG. 6 is an exploded view of a plug module and receptacle module of the electrical blade connector.

As best shown in FIGS. 4-6 a power module 24 includes a housing 26 and a power contact 27, the power contact 27 having a series of individual power or blade terminals 28, 28' received therein. In the embodiment shown, each power blade terminal 28, 28' includes a body portion 30 and a blade portion 36 that is sized according to the current carrying capabilities of the circuit requirements, for instance, circuits requiring a higher current will include power blade terminals or contacts 28, 28' having a substantially large blade portion 36 providing a greater surface area allowing for the transmission of greater current. In this embodiment, as shown in FIG. 4 the module 24 includes adjacent pairs of blade terminals 28, 28' supported on each respective support arm 42 and each pair of terminals 28, 28' having front edge surfaces that are aligned with each other. Additionally, the front edge surface of the first pair of terminals is spaced apart from the front edge of the second pair of terminals along a mating direction.

Figure 7:
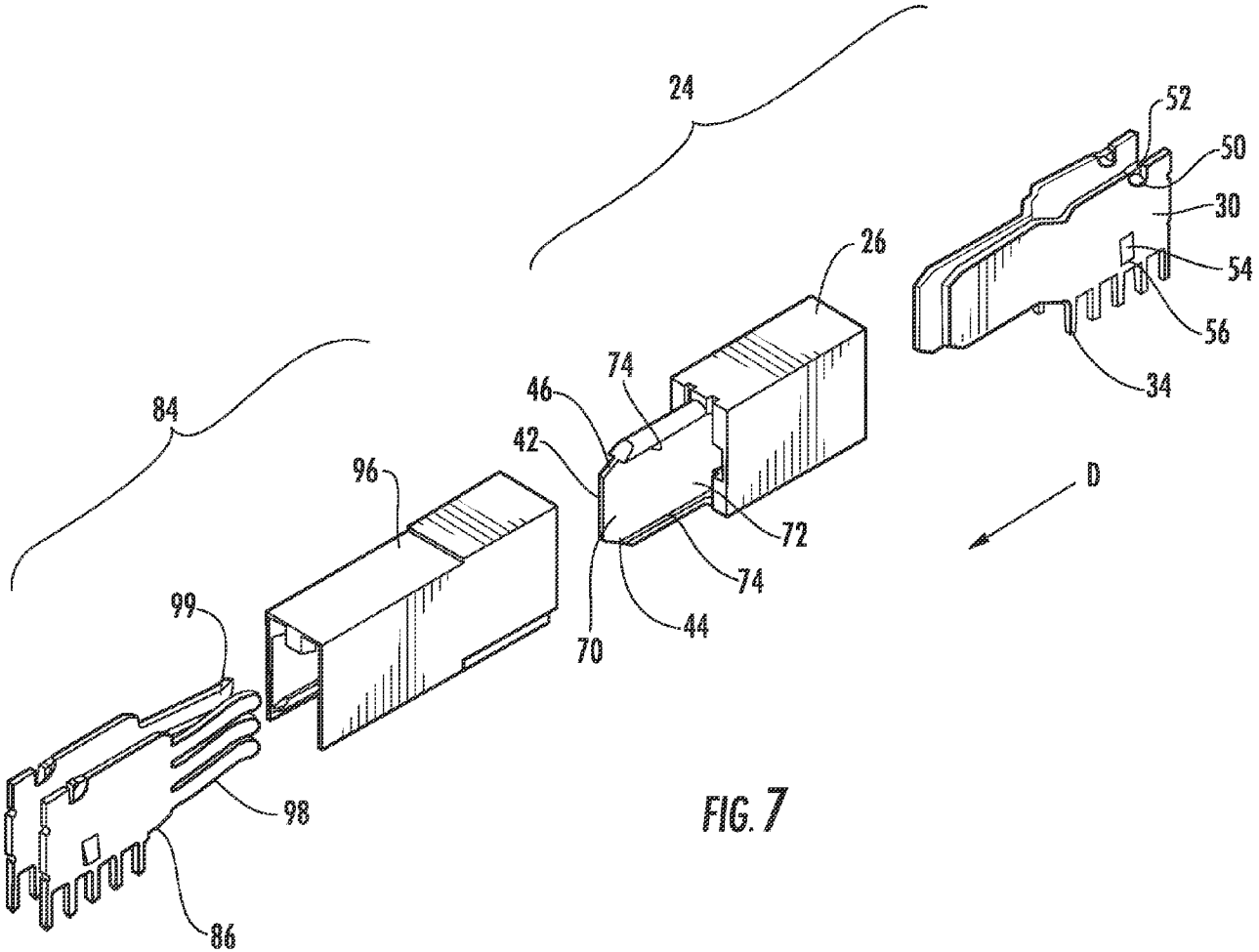
FIG. 7 is an exploded view of an alternative embodiment of a plug module and receptacle module of the electrical blade connector.
Figure 8:
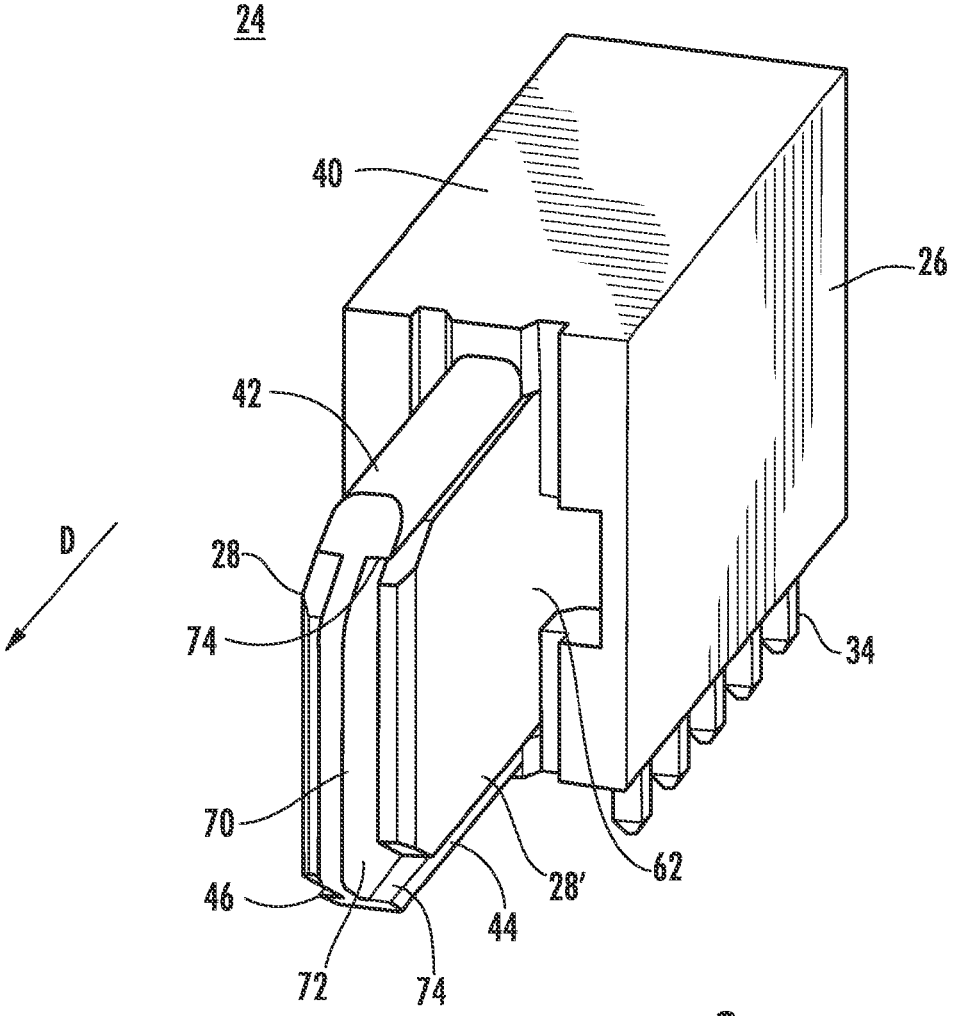
FIG. 8 is a perspective view of the plug power module of FIG. 7.

As illustrated in FIGS. 6-8 the power module 24 includes a housing 26 that receives the power contact 27 therein. The housing 26 has a main body portion 40 and a support arm 42 having a first side 44 and a second side 46 extending in a first direction D corresponding to the mating face of the connector assembly 10. The support arm 42 is positioned in a vertical or upward direction and spaced in a lateral direction along the connector 20 width.

In FIGS. 7-8, the embodiment shown includes a power module 24 having a power contact 27 and a single pair of blade terminals 28, 28' arranged in a back to back relationship, with the blade terminals 28, 28' positioned on either side of the support arm 42. Alternatively, a module 24 or connector 20 is contemplated that may include a plurality of terminal power contacts 27 also arranged in a back to back relationship and spaced laterally along the length of the connector 20 in a spaced apart orientation. In this case, each module 24 or connector 20 will include an equal number of vertically formed support arms 42 corresponding to the total number of power contacts 27.

As best shown in FIGS. 5-8, each power terminal 28, 28' includes a main body portion 30 and a blade portion 36 extending from the body portion 30. Terminal mounting pins 34 are formed from another end or edge of the body portion 30. As best shown in FIG. 7, a series of tails project from an adjacent edge of the body portion 30, in this arrangement a right angle is formed between the blade portion 36 and the terminal tails 34 forming a right angle type configuration. In an alternative arrangement, the terminal tails 34 may extend from an opposite end of the body portion 30 from which the blade portions 36 are formed, this case is considered a vertical type configuration (not shown).

Figure 9:
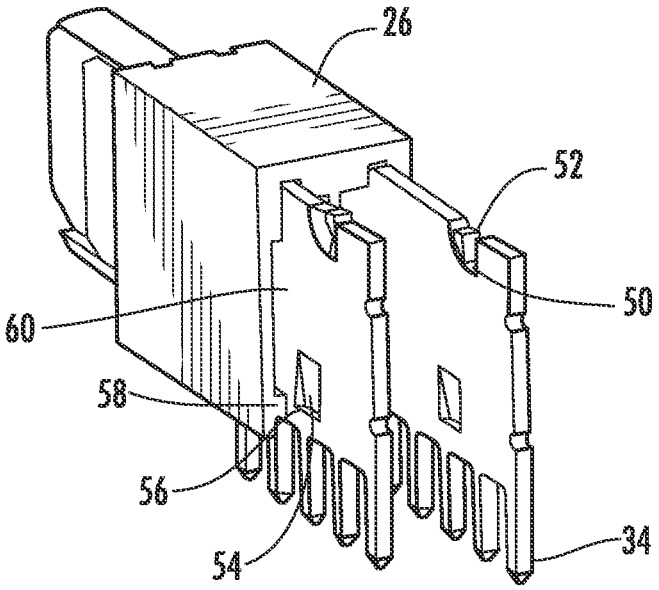
FIG. 9 is a partially explode view of the power module of FIG. 7 looking from the rear of the module.
Figure 10:
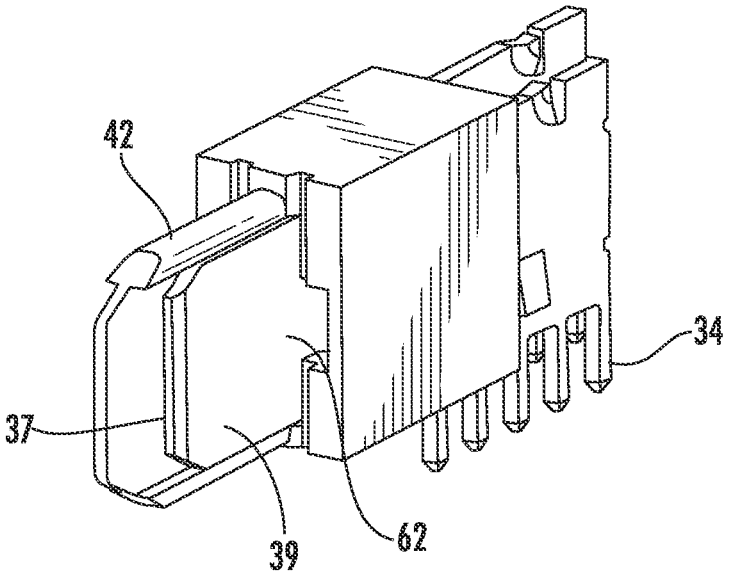
FIG. 10 is a partially explode view of the power module of FIG. 7.

FIGS. 7 and 9 show a locking tab 50 that is formed on a top edge of the body portion 30 for engaging a wall of the housing 26 upon assembly. The locking tab 50 has a tip portion 52 that digs into or skives into the housing 26 upon insertion and is angled in the direction of insertion such that it will resist removal when attempted to be withdrawn from the housing 26. A locating tab 54 having an edge 56 is formed from a side surface of the body portion 30 and engages a shoulder 58 in the housing 26 to properly position the terminal 28, 28' within the housing 26.

As best shown in FIGS. 7-10 the module 24 is assembled with a pair of power blade contacts 28, 28' arranged in a back-to-back relationship with each respective main body portion 30, 30' retained in an insulative housing 26. In this case, each blade portion 36 has an interior surface 37 and an exterior surface 39, with the interior surfaces 37 of the pair of blade terminals 28, 28' facing away from each other. Upon insertion of each terminal 28, 28' the blade portion 36 of each terminal 28, 28' is inserted into the cavity 60 from the rear of the module housing 26 with the blade portion 36 protruding through an opening 62 and extending to the mating end of the module 24 with the locating tab 54 aligned with the shoulder 58 formed in the housing 26 to position each terminal 28, 28' in the cavity 60. Each body portion 30 of the power terminals 28, 28' is fitted into the insulative module housing 26 with the locking tab 50 digging into or skiving in the side wall of the housing 26 and securing each terminal 28, 28' in the housing 26. Alternatively, the power terminals 28, 28' may also be molded within the insulative housing 26.

Each power module 24 has an interlocking structure (not shown) formed on each side of the housing 26 for being secured to an appropriate adjacent power module 24 or signal module 14. The interlocking structure typically utilizes a dove tail structure with appropriate male and female portions of the dovetail (not shown) on respective sides of each module 14, 24. As can be appreciated, other structures such as a "T" shape or any other suitable interlocking shape may be substituted.

In the embodiment shown in FIGS. 7-10 the power module 24 of the embodiment has a power contact 27 that is split apart and formed with an insulator placed between two individual power terminals 28, 28'. The module 24 includes a housing 26 with support arm 42 extending from the main body portion 30 of the module housing 26 and towards the mating face of the connector 20 in a direction D. A variation in the support arm is shown in FIGS. 7-8 and includes a channel 70 disposed on each of the side walls or faces 44, 46 of the support arm 42 and extending along the support arm 42. Each channel 70 is defined having a bottom surface 72 and opposing side walls 74. Each respective blade portion 36 of the corresponding terminal 28, 28' is disposed in the channel 70 with only the outside or exterior surface 39 of the blade portion 36 being exposed. That is, the interior side surface 37 of the blade portion 36 abuts the bottom surface 72 of the channel 70 and each of the side surfaces or edges of the blade portions 36 are adjacent a respective side wall 74 in the channel 70. Similarly, these power terminals 28, 28' can be either press fitted or molded into the insulative module or brick.

In certain instances, it is desirable to have different current carrying loads for individual circuits in certain power applications. For instance, one application may require high current and thus require a power terminal with a large blade portion. Of course, with increased current loads the power terminals will exhibit a temperature increase. The surface area also aids in the dissipation of this heat, consequently each blade portion of certain power terminals can be formed with a different surface area and in the embodiment shown, the lengths of the individual power contact blade portions have different lengths. In another embodiment, the blade portions lengths can be the same for each power contact but the lengths of adjacent power contacts are different. By the use of different lengths and the insulative barrier, the thermal characteristics and electrical characteristics can be tuned accordingly.

A similar arrangement is shown for the receptacle module 84. As illustrated in FIGS. 3 and 7 a pair of receptacle terminals 86 is positioned and secured in an insulative housing 96 for mating with the power terminals 28, 28' of the plug module 24. Each receptacle terminal 86 has a plurality of spring fingers or contacts 98 with a contacting portion 99 that slideably engage the blade portions 36 of the power terminals 28, 28' of the plug module. In an alternative embodiment, shown in FIG. 6, an insulative spacer 87 is positioned between the individual receptacle terminals 86 of the receptacle module 84 and similarly providing the ability to modify or tune the electrical characteristics of the receptacle module 84 and the connector assembly 10.

The receptacle 84 also includes a passageway 85 that extends through the housing 96 allowing for airflow through the receptacle module 84 as well. In this instance as best shown in FIG. 12, the passageway 85 is formed between the receptacle terminals 86 so that upon mating of the plug 24 and receptacle 84 a continuous passageway is created through both the plug 24 and receptacle 84 across the mating interface of the blade terminals 28, 28' and the receptacle terminal 86 to allow direct cooling of the connector system 10.

Figure 11:
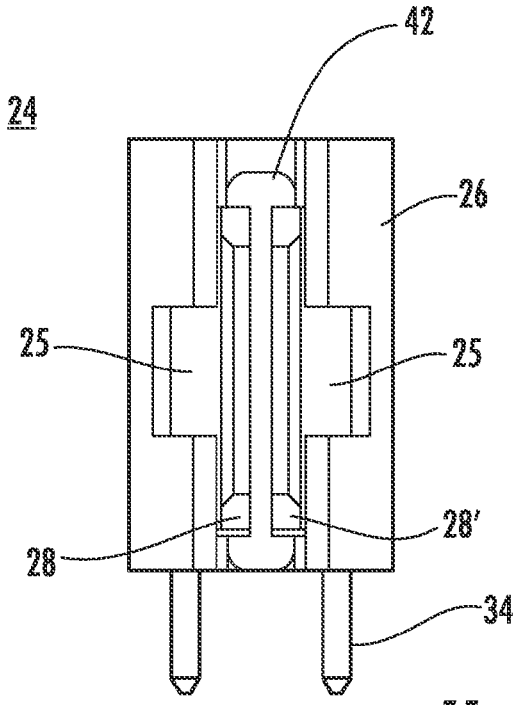
FIG. 11 is a front view of the power module of FIG. 7.
Figure 12:
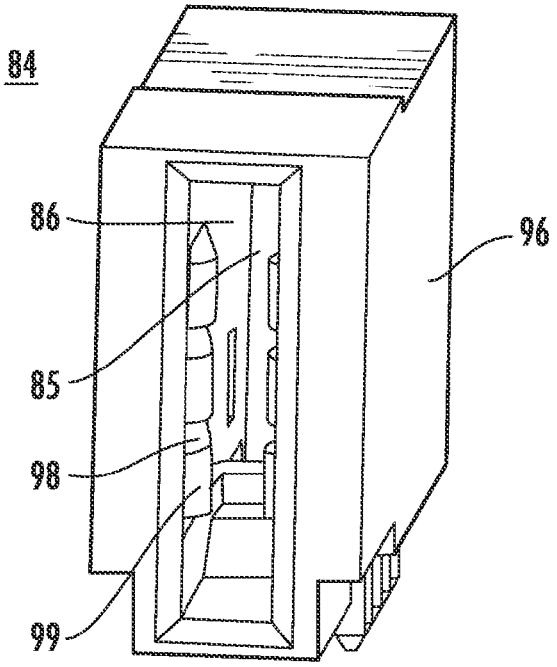
FIG. 12 is a perspective view of the receptacle power module of FIG. 7.

As shown in FIGS. 11-12 the housing 26 of the power module 24 includes a passageway 25 formed through the housing 26 and adjacent each side of the support arm 42. Upon assembly of the terminals 28, 28' the passageway 25 provides a non-restricted area allowing air to flow past each blade terminal 28, 28' to aid in the cooling of the power terminals 28, 28'. The receptacle 84 also includes a passageway 85 that extends through the housing 96 allowing for airflow through the receptacle module 84 as well. In this instance as best shown in FIG. 12, the passageway 85 is formed between the receptacle terminals 86 so that upon mating of the plug 24 and receptacle 84 a continuous passageway is created through both the plug 24 and receptacle 84 across the mating interface of the blade terminals 28, 28' and the receptacle terminal 86 to allow direct cooling of the connector system 10.

As can be appreciated, the placement of two blades close to each other has a beneficial impact on the electrical performance of the connector. As noted above, a current flowing along a path will generate a magnetic field that resists the flow of current. If current is flowing in the opposite direction in close proximity then the two magnetic fields can cancel out and the loop inductance and resultant impedance will be reduced. The depicted embodiments thus allow for a connector that provides for desirable electrical performance while still providing good electrical isolation between positive and negative terminals. In addition, in certain embodiments the blades can be kept in close proximity substantially the entire length of the blades, thus providing a desirable improvement in impedance such that the system can reduce voltage lag. Consequentially, in a system the number of local capacitors that would normally be used to protect against voltage sag can be reduced.

As shown in FIG. 2 the end configurations of each connector assembly 20, 80 include a separate module or end cap 4, 6 that is used to provide an alignment structure to guide the connector system 10 together to prevent stubbing between respective mating modules 24, 84 and individual electrical terminal contacts 28, 86 therein. The guiding element typically is constructed of a post 5 and receiving hole 3 both of which having tapered ends to provide a lead in upon connector mating. Various keying features and may also be included to insure that mis-matching of the connectors does not occur. This arrangement allows for any number of signal and power configurations in a low profile form factor.

It should be noted that in general, while plug connectors and receptacle receptors have been described as having certain features, the depiction of whether a connector is a plug or receptacle type in the figures is done merely for illustrative purposes. Therefore, it is envisioned that a particular connector could be configured to be a plug or a receptacle type or a combination of plug and receptacle, as desired. For example, a connector could include a power contact that is a plug type or a receptacle type and also include a signal contact that is a plug type or a receptacle type. Therefore, unless otherwise noted, the determination of whether a contact is a receptacle or plug is not intended to be limiting.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

What is claimed is:

1. A power module of an electrical connector, the power module comprising:

a dielectric housing, the dielectric housing having a forward face, the dielectric housing having a first support arm projecting forwardly from the forward face, the first support arm having opposing first and second sides, the dielectric housing defining a cavity rearward of the forward face, the forward face having first and second slots extending therethrough which are in communication with the cavity, the first slot being provided adjacent the first side of the first support arm, the second slot being provided adjacent the second side of the first support arm;

a first blade terminal, the first blade terminal having a body portion and a blade portion, the body portion of the first blade terminal being housed in the cavity of the dielectric housing, the blade portion of the first blade terminal extending through the first slot and being positioned alongside the first side of the first support arm, the blade portion of the first blade terminal extending generally parallel to the first support arm; and a second blade terminal, the second blade terminal having a body portion and a blade portion, the body portion of the second blade terminal being housed in the cavity of the dielectric housing, the blade portion of the second blade terminal extending through the second slot and being positioned alongside the second side of the first support arm, the blade portion of the second blade terminal extending generally parallel to the first support arm.

2. The power module according to claim 1, wherein the first support arm projects forwardly from the forward face in a vertical configuration.

3. The power module according to claim 1, wherein a channel is formed on the first side of the first support arm.

4. The power module according to claim 3, wherein the blade portion of the first blade terminal is disposed in the channel.

5. The power module according to claim 3, wherein a channel is formed on the second side of the first support arm.

6. The power module according to claim 5, wherein the blade portion of the first blade terminal is disposed in the channel formed on the first side of the first support arm, and wherein the blade portion of the second blade terminal is disposed in the channel formed on the second side of the first support arm.

7. The power module according to claim 1, wherein the blade portion of the first blade terminal has a length which is different from a length of the blade portion of the second blade terminal.

8. The power module according to claim 1, wherein the blade portion of the first blade terminal has a forward edge surface, and wherein the blade portion of the second blade portion has a forward edge surface, the forward edge surfaces of the blade portions being in alignment.

9. The power module according to claim 8, wherein the first support arm has a forward edge surface, the forward edge surfaces of the blade portions being in alignment with the forward edge surface of the first support arm.

10. The power module according to claim 1, wherein the blade portion of the first blade terminal has a forward edge surface, and wherein the blade portion of the second blade portion has a forward edge surface, the forward edge surfaces of the blade portions being out of alignment.

11. The power module according to claim 10, wherein the first support arm has a forward edge surface, the forward edge surface of one of the blade portions being in alignment with the forward edge surface of the first support arm.

12. The power module according to claim 1, wherein the dielectric housing has a second support arm projecting forwardly from the forward face, the second support arm having opposing first and second sides, the forward face having third and fourth slots extending therethrough which are in communication with the cavity, the third slot being provided adjacent the first side of the second support arm, the fourth slot being provided adjacent the second side of the second support arm, and wherein the power module further comprises a third blade terminal and a fourth blade terminal, the third blade terminal having a body portion and a blade portion, the body portion of the third blade terminal being housed in the cavity of the dielectric housing, the blade portion of the third blade terminal extending through the third slot and being positioned alongside the first side of the second support arm, the blade portion of the third blade terminal extending generally parallel to the second support arm, the fourth blade terminal having a body portion and a blade portion, the body portion of the fourth blade terminal being housed in the cavity of the dielectric housing, the blade portion of the fourth blade terminal extending through the fourth slot and being positioned alongside the second side of the second support arm, the blade portion of the fourth blade terminal extending generally parallel to the second support arm.

13. The power module according to claim 1, wherein the dielectric housing has a lower face, the lower face having at least one slot extending therethrough which is in communication with the cavity.

14. The power module according to claim 13, wherein the first and second blade terminals have terminal mounting pins extending downwardly from their respective body portions, the terminal mounting pins extending at least partially through the at least one slot in the lower face and terminating at a location below the lower face.

15. The power module according to claim 13, wherein the dielectric housing has a rearward face, the rearward face having the at least one slot extending therethrough which is in communication with both the cavity and the at least one slot extending through the lower face of the dielectric housing.

16. The power module according to claim 15, wherein the first and second blade terminals are inserted into the cavity of the dielectric housing via the at least one slot of the rearward face of the dielectric housing before the blade portions of the first and second blade terminals are inserted into and through the first and second slots of the forward face of the dielectric housing.

17. The power module according to claim 16, wherein the cavity defines a first interior, upwardly-facing shoulder of the dielectric housing, and wherein the body portion of the first blade terminal has a tab extending outwardly therefrom, the tab having a lower edge, the lower edge of the tab of the first blade terminal configured to engage the first shoulder of the dielectric housing in order to properly position the first blade terminal within the cavity of the housing.

18. The power module according to claim 17, wherein the cavity defines a second interior, upwardly-facing shoulder of the dielectric housing, and wherein the body portion of the second blade terminal has a tab extending outwardly therefrom, the tab having a lower edge, the lower edge of the tab of the second blade terminal configured to engage the second shoulder of the dielectric housing in order to properly position the second blade terminal within the cavity of the housing.

19. The power module according to claim 16, wherein the cavity defines a first interior wall of the dielectric housing, and wherein the body portion of the first blade terminal has a tab formed on a top edge thereof, the tab having a tip portion that is configured to dig into the first interior wall of the dielectric housing upon insertion of the first blade terminal into the cavity of the housing, and wherein the tip portion is angled in the direction of insertion such that the tip portion of the first blade terminal will resist removal when the first blade terminal is attempted to be withdrawn from the cavity of the housing.

20. The power module according to claim 19, wherein the cavity defines a second interior wall of the dielectric housing, and wherein the body portion of the second blade terminal has a tab formed on a top edge thereof, the tab having a tip portion that is configured to dig into the second interior wall of the dielectric housing upon insertion of the second blade terminal into the cavity of the housing, and wherein the tip portion of the second blade terminal is angled in the direction of insertion such that the tip portion will resist removal when the second blade terminal is attempted to be withdrawn from the cavity of the housing.

21. An electrical connector, the electrical connector comprising:

a signal module assembly, the signal module assembly including at least one signal module; and a power module assembly, the power module assembly being secured to the signal module assembly with an interlocking structure, the power module assembly including at least one power module, the at least one power module comprising, a dielectric housing, the dielectric housing having a forward face, the dielectric housing having a first support arm projecting forwardly from the forward face, the first support arm having opposing first and second sides, the dielectric housing defining a cavity rearward of the forward face, the forward face having first and second slots extending therethrough which are in communication with the cavity, the first slot being provided adjacent the first side of the support arm, the second slot being provided adjacent the second side of the first support arm, a first blade terminal, the first blade terminal having a body portion and a blade portion, the body portion of the first blade terminal being housed in the cavity of the dielectric housing, the blade portion of the first blade terminal extending through the first slot and being positioned alongside the first side of the first support arm, the blade portion of the first blade terminal extending generally parallel to the first support arm, and a second blade terminal, the second blade terminal having a body portion and a blade portion, the body portion of the second blade terminal being housed in the cavity of the dielectric housing, the blade portion of the second blade terminal extending through the second slot and being positioned alongside the second side of the first support arm, the blade portion of the second blade terminal extending generally parallel to the first support arm.

22. The electrical connector according to claim 21, wherein the signal module assembly and the power module assembly are aligned in a linear array with the interlocking structure securing the signal and power module assemblies together in a side-by-side arrangement.

23. The electrical connector according to claim 21, wherein the at least one signal module includes a series of over-molded wafers having a number of signal circuits held within a holding assembly.

24. The electrical connector according to claim 21, wherein the blade portion of the first blade terminal has a length which is different from a length of the blade portion of the second blade terminal.

25. The electrical connector according to claim 21, wherein the blade portion of the first blade terminal has a forward edge surface, and wherein the blade portion of the second blade portion has a forward edge surface, the forward edge surfaces of the blade portions being in alignment.

26. The electrical connector according to claim 25, wherein the first support arm has a forward edge surface, the forward edge surfaces of the blade portions being in alignment with the forward edge surface of the first support arm.

27. The electrical connector according to claim 21, wherein the blade portion of the first blade terminal has a forward edge surface, and wherein the blade portion of the second blade portion has a forward edge surface, the forward edge surfaces of the blade portions being out of alignment.

28. The electrical connector according to claim 27, wherein the first support arm has a forward edge surface, the forward edge surface of one of the blade portions being in alignment with the forward edge surface of the first support arm.

29. The electrical connector according to claim 21, wherein the power module assembly has at least a first power module and a second power module, wherein the blade portions of the first and second blade terminals of the first power module have a first length, and wherein the blade portions of the first and second blade terminals of the second power module have a second length, and wherein the first length is different from the second length.

30. The electrical connector according to claim 29, wherein the first power module is adjacent to the second power module.

31. A connector assembly, the connector assembly comprising:

a first connector, the first connector having a power module assembly, the power module assembly including at least one power module, the at least one power module comprising, a dielectric housing, the dielectric housing having a forward face, the dielectric housing having a first support arm projecting forwardly from the forward face, the first support arm having opposing first and second sides, the dielectric housing defining a cavity rearward of the forward face, the forward face having first and second slots extending therethrough which are in communication with the cavity, the first slot being provided adjacent the first side of the support arm, the second slot being provided adjacent the second side of the first support arm, a first blade terminal, the first blade terminal having a body portion and a blade portion, the body portion of the first blade terminal being housed in the cavity of the dielectric housing, the blade portion of the first blade terminal extending through the first slot and being positioned alongside the first side of the first support arm, the blade portion of the first blade terminal extending generally parallel to the first support arm, and a second blade terminal, the second blade terminal having a body portion and a blade portion, the body portion of the second blade terminal being housed in the cavity of the dielectric housing, the blade portion of the second blade terminal extending through the second slot and being positioned alongside the second side of the first support arm, the blade portion of the first blade terminal extending generally parallel to the first support arm; and a second connector, the second connector having a power module assembly, the power module assembly including at least one power module, wherein the at least one power module of the second connector is configured to be mated with the at least one power module of the first connector.

32. The connector assembly as defined in claim 31, wherein the first connector further includes a signal module assembly, the signal module assembly including at least one signal module, and wherein the second connector further includes a signal module assembly, the signal module assembly including at least one signal module, wherein the at least one signal module of the first connector is configured to mate with the at least one signal module of the second connector.

33. The connector assembly as defined in claim 31, wherein the at least one power module of the second connector includes an insulative housing and a pair of receptacle terminals, the pair of receptacle terminals being positioned and securing in the insulative housing and being configured to mate with the first and second blade terminals of the at least one power module of the first connector.

34. The connector assembly as defined in claim 33, wherein the at least one power module of the second connector includes an insulative spacer, the insulative spacer being positioned between the pair of receptacle terminals.

35. The connector assembly as defined in claim 33, wherein, when the at least one power module of the second connector is mated with the at least one power module of the first connector, a passageway is provided through both the dielectric housing of the first connector and the insulative housing of the second connector, the passageway being provided across a mating interface of the first and second blade terminals and the pair of receptacle terminals to allow direct cooling of the connector assembly.

* * * * *